US010011342B2

(12) United States Patent
Gai et al.

(10) Patent No.: US 10,011,342 B2
(45) Date of Patent: Jul. 3, 2018

(54) DIRECTIONAL CONTROL SYSTEM FOR A BOAT

(71) Applicants: Marcella Gai, Casella (IT); Enrico Pagani, Casella (IT)

(72) Inventors: Marcella Gai, Casella (IT); Enrico Pagani, Casella (IT)

(73) Assignee: Ultraflex S.p.A., Casella (GE) (IT)

( * ) Notice: Subject to any disclaimer, the term of this patent is extended or adjusted under 35 U.S.C. 154(b) by 0 days.

(21) Appl. No.: 15/291,558

(22) Filed: Oct. 12, 2016

(65) Prior Publication Data

US 2017/0101166 A1 Apr. 13, 2017

(30) Foreign Application Priority Data

Oct. 13, 2015 (IT) ..... 102015000061178

(51) Int. Cl.

| | |
|---|---|
| ***B63H 25/34*** | (2006.01) |
| ***B63H 25/38*** | (2006.01) |
| ***B63H 20/00*** | (2006.01) |
| *B63H 25/02* | (2006.01) |

(52) U.S. Cl.

CPC ..... *B63H 25/38* (2013.01); *B63H 21/265* (2013.01); *B63H 2025/024* (2013.01)

(58) Field of Classification Search

CPC ..... B63H 25/42; B63H 20/12; B63H 21/12

See application file for complete search history.

(56) References Cited

U.S. PATENT DOCUMENTS

| | | | | |
|---|---|---|---|---|
| 7,325,507 | B1 | 2/2008 | Hundertmark | |
| 7,681,513 | B1 | 3/2010 | Hundertmark | |
| 2006/0217011 | A1* | 9/2006 | Morvillo | B63B 39/00 440/40 |
| 2010/0076633 | A1* | 3/2010 | Murru | B63H 25/42 701/21 |

FOREIGN PATENT DOCUMENTS

| | | |
|---|---|---|
| DE | 3826909 | 2/1989 |
| JP | 2011111127 | 6/2011 |

* cited by examiner

*Primary Examiner* — Stephen P Avila

(74) *Attorney, Agent, or Firm* — Themis Law

(57) ABSTRACT

A steering control system for a watercraft includes a pivoting steering tiller manually operated and operatively connected to a direction changing member acting on or into the water, such as a rudder blade or an outboard motor; and a system locking the steering tiller in the steering position, which can be activated for keeping the tiller in a predetermined pivoting position and deactivated for allowing the tiller to be moved in a pivoting position to carry out a change in direction. According to the invention the locking system is switchable by way of switching actuators that are controlled by a control member provided on the arm.

8 Claims, 4 Drawing Sheets

DIRECTIONAL CONTROL SYSTEM FOR A BOAT

FIELD OF THE INVENTION

The present invention relates to a steering control system for a watercraft comprising a pivoting steering tiller manually operated and operatively connected to a direction changing member acting on or into the water, such as a rudder blade or an outboard motor; and means locking the steering tiller in the steering position, which can be activated for keeping said tiller in a predetermined pivoting position and can be deactivated for allowing said tiller to be moved in a pivoting position to carry out a change in direction.

BACKGROUND OF THE INVENTION

Systems of this type are known, for example from U.S. Pat. No. 7,325,507. This document provides for the steering action, namely, the force exerted on the steering tiller or on the steering arm of the motor through said tiller, to be exerted manually by an operator. The system only exerts an action locking the motor or the rudder and therefore the steering tiller when a change in direction, that is a change in the course, is not desired. This is advantageous since, in presence of very powerful motors or with considerable surfaces of the rudder, the force that has to be exerted on the steering tiller is considerable and has to be maintained all the time, in order to avoid a spontaneous change in the orientation of the rudder blade or of the motor, which, in combination with the hydrodynamic behavior of the watercraft and of the motor, and with reference also to the shape of the propeller, tends to reach the greatest possible pivoting angle of the tiller and of the rudder or of the motor. A situation like this is very dangerous above all when cruising speed is high.

Besides such passive system, document U.S. Pat. No. 6,715,438 describes an active system wherein the steering action performed on the tiller is converted into a control pulse, changing the corresponding steering angle, by an actuator changing the rotation of the motor or of the rudder. This document shows the actuator to be a hydraulic actuator of the type known in hydraulic steering systems used in watercrafts both for moving the blades of the rudder or rudders with inboard motors and for moving the motors when those are of the outboard type.

In both documents, however, the control member, which is composed of an end grip part of the steering tiller, which part is mounted so as to pivot according to an axis substantially parallel to the axis of rotation of the motor or of the rudder blade, operates a valve that opens a circuit supplying the pressurized fluid to one or both the chambers of an actuating cylinder.

In the case of document U.S. Pat. No. 7,325,507, a circuit connects the two chambers of a double-acting cylinder. The opening of the valve, mechanically controlled by the pivoting movement of the end part of the steering tiller with respect to the part associated to the motor, enables the fluid to flow from one to the other chamber of the cylinder and, therefore, makes the tiller free to be pivoted.

In the version where the rotation of the tiller is performed by a non-manual force, the pivoting movement of the end part of the steering tiller always activates, through a control with a valve, the passage of a pressurized fluid from one pressurized tank to the chamber of the cylinder, which, therefore, by being displaced with respect to the rod causes the arm of the motor connected to the cylinder to be displaced.

By bringing back the grip part in the rest position, the valve closes the passage and the movement is locked till the end part of the steering tiller is again operated.

Currently, systems actuating the steering of rudders or outboard motors or the like are also known, which use mechanical actuators that directly transmit, by a transmission for example through cables of the push-pull type, the motion of a steering wheel to the blade or to the motor.

Moreover, systems are known that use combinations of electromechanical, electromagnetic, or electrohydraulic actuators.

The provision of valves activating the conditions locking and unlocking the displacement of the steering tiller or activating oil-hydraulic means actuating the steering require quite complicated arrangements and considerable encumbrances. Moreover, the increasing tendency in known modern steering tillers is to mount on the steering tiller a plurality of controls for different functionalities for controlling the watercraft, such as for example controls for motor tilt, controls for trim of motors, controls for the reversing gear of the motor, for controlling the number of revolutions of the motor and so on. This results in more and more reduced spaces available in the steering tiller and is increasingly difficult to avoid interferences between the several mechanisms housed in the tiller body, resulting in potential dangerous conditions or difficult maintenance conditions.

SUMMARY OF THE INVENTION

The invention aims at improving a system of the type described hereinbefore, which, by means of simple arrangements, overcomes the above described drawbacks and provides for a more flexible system that is easy to be mounted and repaired and has a small encumbrance in the steering tiller.

The invention achieves the above objects by a steering control system for a watercraft, which includes:

a pivoting steering tiller manually operated and operatively connected to a direction changing member acting on or into the water, such as a rudder blade or an outboard motor; and means locking the steering tiller in the steering position, which can be activated for keeping said tiller in a predetermined pivoting position and can be deactivated for enabling said tiller to be moved into a pivoting position to carry out a change in direction, wherein said locking means are switchable by way of switching actuators that are controlled by a control member provided on the arm.

In this case, by providing in the actuating tiller only a control member of an actuator, the actuator can be displaced outside of the tiller and for example placed in a oil-hydraulic version as the one described above, in the area of the actuating cylinder.

As it will be shown below, this design enables the construction of the tiller to be simpler and safer, but also to easily provide interfaces for the connection of the system to one or more remote control stations, that are not only stationary but also movable and connected by cables or wirelessly according to one or more of the currently available communication protocols, such as Wi-Fi or the like.

The actuating means that act on locking means can be mechanical, electric, electromechanical, electromagnetic, electronic, hydraulic, oil-hydraulic or the like and likewise the control means of said actuator can also be mechanical, electric, electromechanical, electromagnetic, electronic, hydraulic or oil-hydraulic.

However, advantageously, a preferred embodiment provides for the control members to be of the mechanical, electromechanical, electromagnetic, electric or electronic.

In this case a manual action on said control means can operate on a switch activating/deactivating a controller generating a power pulse driving the locking means or can close a supply circuit of said locking means.

Therefore, the steering tiller has to house simply two switches that detect the different displacement directions, for example of the end part of the tiller associated to the grip with respect to the part of the tiller fastened to the motor or directly or indirectly to the blade of the rudder or of a different control member.

The operation of one or the other switch can generate a pulse interpreted by a controller supplying the locking means to generate a signal disabling said means, or can close the supply circuit of the locking means, causing them to be temporarily disabled and therefore causing the rotational movement of the tiller and, therefore, of the motor or of the rudder blade to be released.

If the system provides active steering actuating means as in the case of document U.S. Pat. No. 6,715,438, then the control signal can be sent to the valve enabling the supply of the pressurized fluid that drives the steering actuating cylinder.

Therefore, the tiller has to house at least two switches or a three-way switch and not at the same time structures such as complicated valves and hydraulic means opening and closing them. In addition to the advantage of simplicity and space, there is the advantage of reducing risks of malfunctions since the system is simpler and above all the valves and the hydraulic control means do not require an excessive miniaturization.

Even when the locking means are electromechanical, electromagnetic or the like, the control member generating the control pulses for activating/deactivating said locking means may be composed of one or more switches that open and close a supply circuit of the actuator, which activate or deactivate the locking condition or which control an electronic circuit generating power signals.

On the contrary, in the case of a mechanical locking device, the control member transmits a control or actuating movement to a locking mechanism through a mechanical transmission, which, in a preferred solution, is composed of one or more push-pull cables. The movement of the control member is transmitted from the cable to a mechanism acting on a movable part of the locking means operatively connected to the rotation arm of the motor or to the steering tiller, the movable part being coupled to a stationary part constrained to the watercraft, for example to the transom, and the mechanism integral with the stationary part engaging the movable part and preventing it from accomplishing a relative movement.

According to another feature, the locking device can be provided in combination with a brake or can be composed of a brake acting between the movable part and the stationary part of the locking means.

The brake can be hydraulic, mechanical, electromechanical, electromagnetic or the like and can act only for changing the friction of rotation of the motor or of the rudder or also for exerting the locking action.

For example, in the case of a hydraulic system, the brake can be composed of another valve adjusting the flow rate of the fluid flow. By adjusting the flow rate, the resistance to the displacement of the steering tiller, that is, of the rotation of the motor or of the rudder blade, changes correspondingly.

Similarly. the brake in the mechanical version can be composed of one or more shoes or of one or more friction elements brought by one or the other movable or stationary parts and acting on the corresponding stationary or movable part respectively in combination with means compressing said shoes or friction elements.

In this case, the completely mechanical version is possible with a mechanical transmission between the control member and the support of the shoe or friction pad or a version is possible with hydraulic control as in motor vehicles or in motorcycles.

Alternatives to such mechanical brake are composed of the well-known electromagnetic or electromechanical brakes.

The operation of the brake occurs by way of an electric actuator or the brake acts not by friction, but by generating opposite electromagnetic forces due to electromagnetism.

For example, the electromagnetic brake is known and widely used for changing resistance in training devices such as exercise bikes, steppers and other devices.

In the version that provides the brake to be operated by an electric signal, the friction exerted on the rotation of the motor and/or of the rudder blade can be changed automatically and/or by manual control.

In this case, the control member acts by generating regulation pulses that are interpreted by a controller regulating the braking action by modifying it to achieve increase or decrease steps depending on the number of pulses.

In one embodiment, the regulation to be performed in a manner corresponding to the length of the pulse.

In one embodiment, when the control pulse exceeds a given duration, the regulation is that of maximum braking or maximum reduction in the braking action, substantially corresponding to the condition locking and unlocking the rotation.

According to a variant embodiment, a system according to the present invention provides for at least control steering remote stations.

In the version that provides for a hydraulic cylinder as the locking means, the manual control on the steering tiller can be bypassed by providing an interface that connects, to the chambers of cylinder actuating supply and return ducts, a pressurized fluid that is supplied by a conventional pump driven by a steering wheel or the like and provided in the remote station.

A combination of check valves in a multiple-way manifold enables the connection of several remote stations distributed on the watercraft to the same cylinder.

The embodiment, in which an actuating cylinder is controlled by the steering tiller, is also easily connectable to a steering remote station similarly to the above described solution.

In the case of electric, electromechanical or electromagnetic controls, since the control member acts on one or more switches or on one or more signal generators, the bypass of said switches is even simpler. However, in this case active actuators must be provided that move the motor or the blade, such as for example electric motors, electromechanical, magnetic, electromagnetic actuators and the like.

Additional features of a system according to the invention are also described hereinafter.

BRIEF DESCRIPTION OF THE DRAWINGS

These and other characteristics and advantages deriving therefrom will be clearer from the following description of some embodiments shown in the enclosed drawings, in which.

DETAILED DESCRIPTION OF EMBODIMENTS OF THE INVENTION

Figure 1:
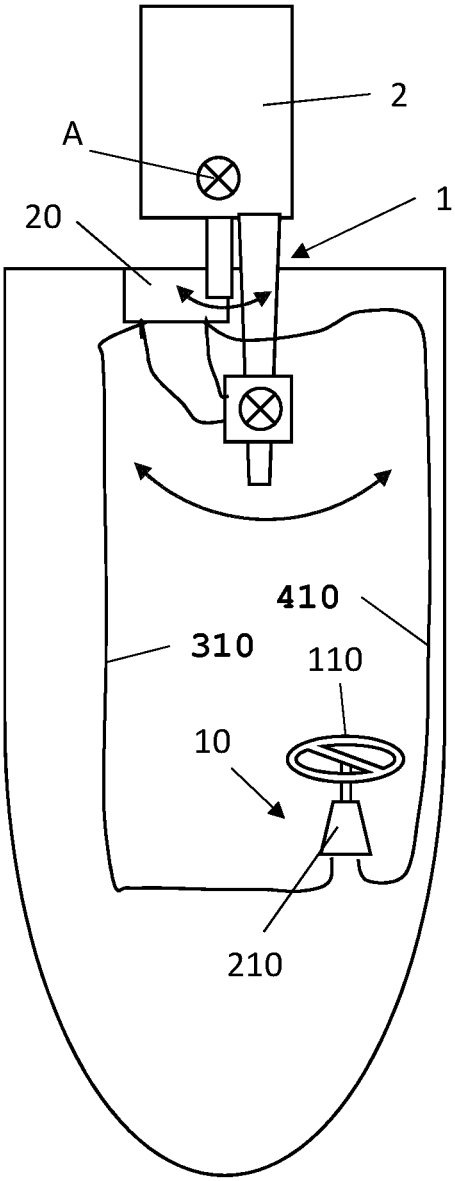
FIG. 1 is a schematic example of a system according to the present invention, wherein, besides a steering control using a steering tiller 1, steering control can be performed also by a remote station generally denoted by 10.

FIG. 1 schematically shows a watercraft with an outboard motor 2 fastened to the transom. A steering tiller 1 is fastened to the outboard motor 2 and can be provided with different control members for controlling different functionalities of the motor, such as the number of revolutions of the motor, the forward direction or the idle condition, or the position of the motor with respect to the transom.

The steering tiller 1 is integral with the mounted motor so as to rotate together with the tiller about a steering axis denoted by A.

FIG. 1 depicts an additional steering control station 10 having a steering wheel 110, and a generator of signals controlling an actuating unit 20.

Figure 2:
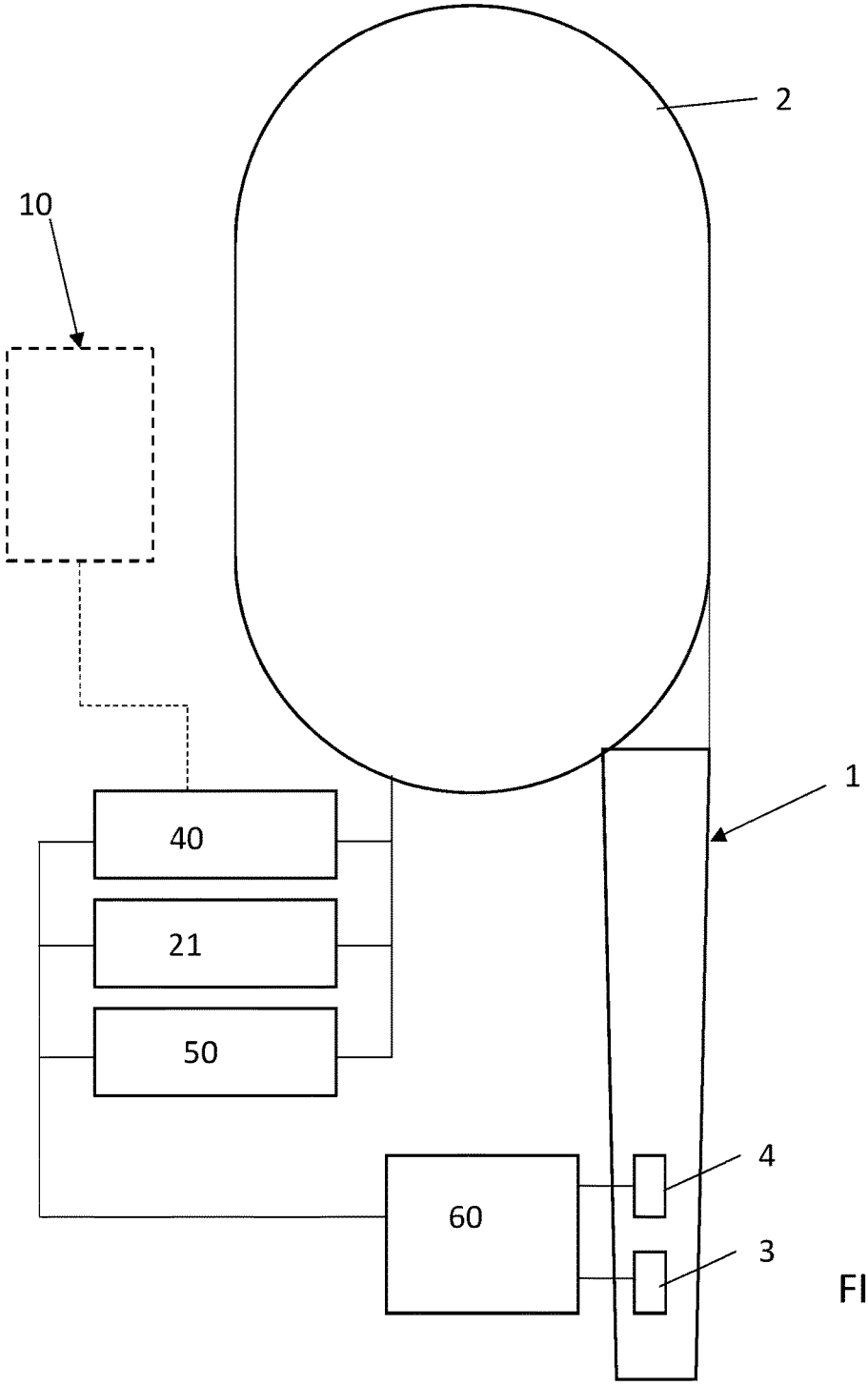
FIG. 2 is a block diagram of a system according to the invention, in which a possible additional steering control station is denoted by broken lines.

FIG. 2 shows the system in greater details.

According to the present invention, control members 3 and 4 are associated to the steering tiller 1.

The characteristics of the invention that will be disclosed below can be provided as an alternative or in combination with one another.

Moreover, the described embodiments relate to an oil-hydraulic arrangement. As it is already clear in the introduction of the present description, there are alternatives that may be electric, electromechanical, electromagnetic or mechanical. These alternatives will be described only with reference to the features that are required to adapt them for performing the functions described with reference to the oil-hydraulic examples. On the contrary, features considered to be known or within the general knowledge of a person skilled in the art will not be discussed.

A first feature of the invention provides for means 21 that lock the rotation of the motor and that are controlled by a control member 3, also identified as a locking actuator.

The locking actuator 21 acts on the motor or on the steering tiller 1 preventing the motor from rotating about the axis A till a control signal generated by the control member 3 causes the locking actuator to be deactivated making it possible to rotate the motor again about the axis A.

There are different possibilities for generating the control signal that can be electric, mechanical or hydraulic, that is oil-hydraulic depending on the type of locking actuator 21 that is provided.

In the case of an electric, electromechanical or electromagnetic actuator, the control member can be a simple switch that closes and opens a circuit supplying the signal supplying said actuator.

As an alternative the signals generated by the control member can be sent to transforming/processing units that in turn control the locking actuator.

Such transforming/processing unit denoted by 5 can be an electric, electronic controller or a hydraulic controller provided for example with one or more solenoid valves, or also an electric actuator motorizing a locking mechanism.

Figure 3:
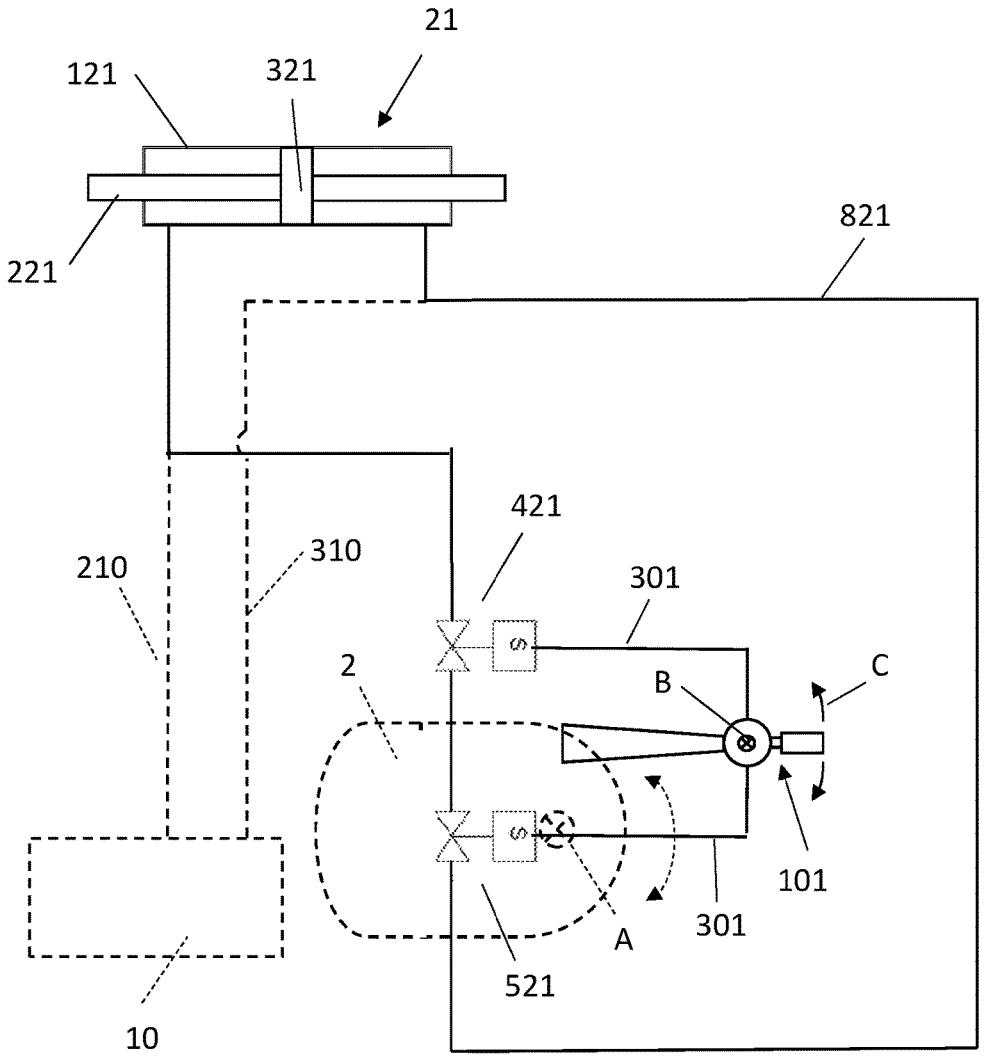
FIG. 3 is a circuit diagram of an oil-hydraulic system according to the invention, in which an oil-hydraulic device is provided locking the steering rotation of the motor or of the steering tiller.

An example of such first variant using a hydraulic locking actuator 21 is shown in FIG. 3.

In the example of FIG. 3 an actuating cylinder 121 with a rod 221 and a piston 321 dividing the cylinder chamber 121 into two separated chambers is fastened by said rod, for example, to the transom of the watercraft, directly or by means of the member fastening the motor to the watercraft. Thus, a change in the oil in the chambers entering in one chamber and exiting from the other one respectively generates the displacement of the cylinder along the rod. For example the steering arm of the motor or as an alternative or in combination a part of the steering tiller 1 is constrained to the cylinder.

The two chambers of the cylinder are connected to each other by a bypass circuit 821 wherein at least one, preferably two solenoid valves 421, 521 are present for closing/opening the circuit.

Preferably with no control signals, the two valves 421, 521 are firmly in the closing condition of the circuit, therefore the fluid cannot pass from one chamber to the other one and, therefore, the motor is prevented from rotating about the axis A.

When, by means of a control member, a signal activating the two valves 421, 521 is generated, these are brought into an opening condition and the fluid can flow between the two chambers of the cylinder 121, allowing a rotation of the motor about the axis A.

The means generating the signal, that is the control member, can be any type and can be directly mounted on or integrated with the tiller 1.

A particular, but not limitative, embodiment provides the tiller 1 to have one end 101 pivoting about an axis B for example in two opposite directions with respect to a neutral central position as denoted by arrows C.

The pivoting movement of the end part 101 is used, for example, for controlling switches (not shown in detail) that close an electric supply circuit 301 towards the two valves, such that the two valves open when a movement of the tiller 1 in one or in the other steering direction is carried out on the tiller causing, as a first response, the end part to pivot in the movement direction and, therefore, causing the valves 421, 521 to be opened and the rotation of the motor about the axis A to be released due to the steering action exerted on the tiller 1 that moves correspondingly to the duration of the steering action exerted on it.

In the alternative, instead of a cylinder 121, locking actuators of the electromechanical, mechanical, electromagnetic type or the like may be provided.

In this case the switches controlled by the end part of the tiller 101, for example, close a supply circuit of said actuators of the electric, electromechanical, electromagnetic type or the like or control generators of signals controlling such actuators in the sense of unlocking the rotation of the motor.

Generally electric, electromechanical or electromagnetic actuators can provide two parts movable with respect to each other, of which a stationary part is the equivalent of the rod 221 and one movable part with respect to said stationary part is the equivalent of the cylinder 121. Between said two parts it is possible to provide means for mutual engagement in a predetermined relative position, and such means can be removed by supplying an unlocking signal.

The engagement means can be composed of mechanical means, such as snap-on means or friction means, or of electromagnetic forces opposing the mutual displacement of said two parts.

Figure 4:
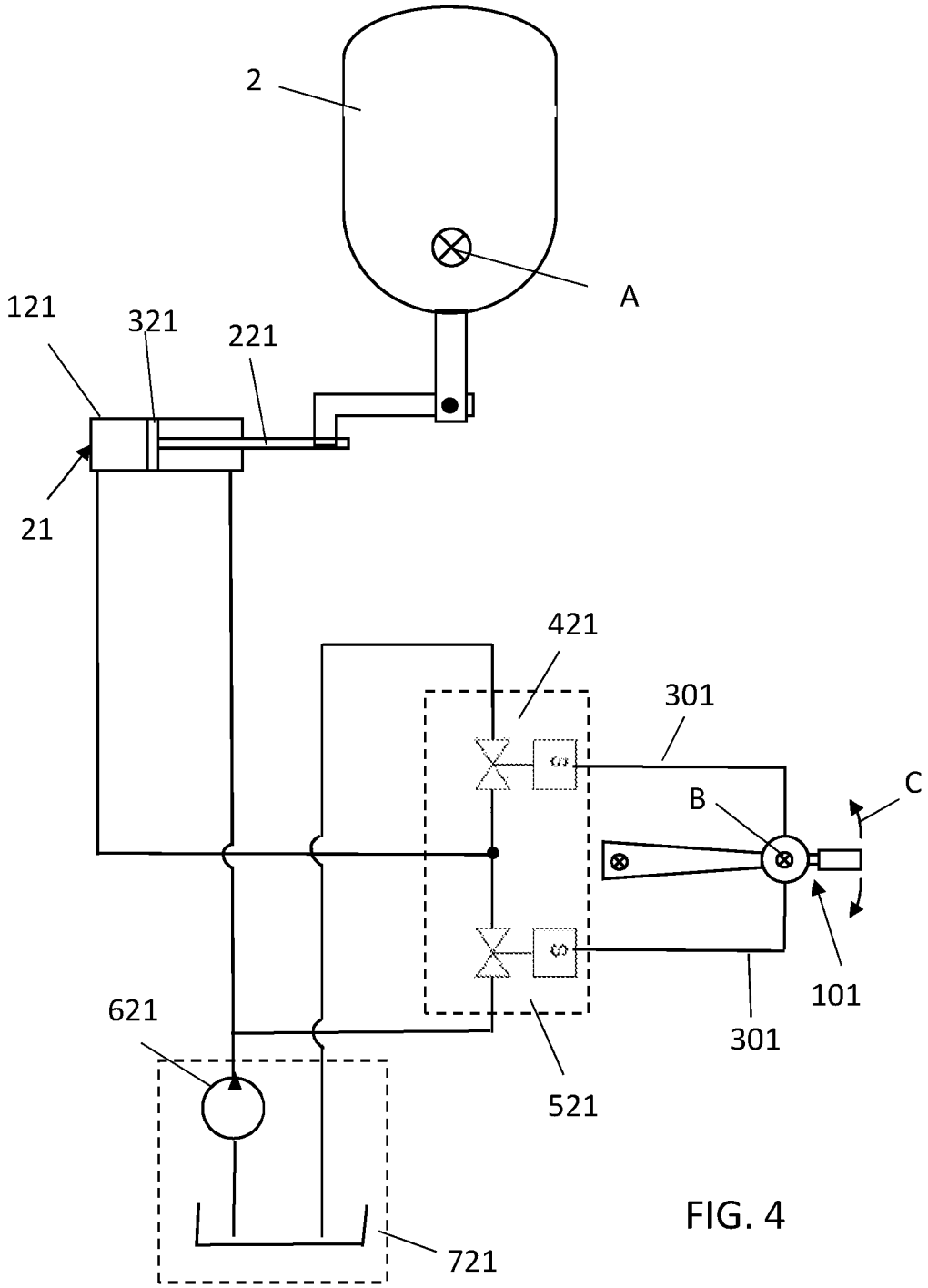
FIG. 4 is a circuit diagram of an oil-hydraulic system according to the invention, in which an oil-hydraulic device actuates the steering controlled by the steering tiller.

FIG. 4 shows a block diagram of a variant of the system according to FIG. 3.

In FIG. 4 identical parts or parts having identical functions will be denoted by the same reference numerals as in FIG. 3.

The example of FIG. 4 provides as another improvement in that, besides keeping the motor locked in position relative to its angular position with reference to the steering axis A thereof, the rotation of the motor is not longer generated by a force exerted directly, manually by the steering tiller 1, but it is exerted by the oil-hydraulic actuator 31.

Such actuator acts on the steering arm of the motor and it is supplied by pressurized oil, fed by an oil supplying pump 621. The oil supplied to one of the chambers of the cylinder, depending on the direction of rotation of the motor, is taken from a tank 721 and the oil expelled by the other chamber is brought again to the tank.

In the circuit there are provided two solenoid valves 421 and 521 that are controlled in a like manner as described in FIG. 3 by switches that open and close a supply circuit and that are operated by control members provided on or integrated in the tiller 1.

In particular, the example of FIG. 4 includes a tiller end part 101 pivoting about an axis B, whose travel is used to control the switches.

Even such variant can provide in the alternative for other types of steering actuators that can be mechanical, electromechanical, electromagnetic and the like, and different variants already disclosed for the embodiment of FIG. 3 are valid with adaptations if necessary.

With reference again to FIG. 3, but also FIG. 4, interfaces may be provided for the connection of at least one or more further steering control stations that are situated in other locations of the watercraft, such as shown by way of example in FIG. 1.

With reference to the embodiment of FIG. 3 that specifically provides for an oil-hydraulic system, the remote steering station 10 can be composed of a conventional oil-hydraulic steering system that includes a steering control member, such as a steering wheel or the like 110 (see FIG. 1), which is fitted on the shaft driving a pump 210. The pump is operated by the rotation of the steering wheel and is connected to the two chambers of the cylinder through ducts having a delivery or return function depending on the direction of rotation of the steering wheel 110. A system of this type is known and it is widely used in oil-hydraulic steering systems.

The delivery/return ducts 310, 410 are connected to each one of the chambers of the cylinder 121 respectively.

This embodiment is schematically shown by broken lines in FIG. 3. Such solution can be applied also in the example of FIG. 4 with simple and obvious adaptations as for FIG. 3.

It is immediately clear that except for the possible provision of check valves to avoid pressurized oil generated by the remote station 10 to flow in the bypass circuit, no difficulties and no changes or important arrangements are required for the connection of the remote station.

As regards the possible electric, electromechanical or electromagnetic variant, with reference to FIG. 3, with respect to the preceding description, the provision of a remote station alternative to the tiller 3 or in addition to the tiller 3 requires at least one actuator intended to receive signals of such type and to convert them into a steering actuating travel of the motor. In particular, by associating means that convert the displacement of a steering control member, for example the rotation of the steering wheel 110 of FIG. 1 into an electric signal corresponding to said displacement travel, such signal can be supplied to a controller that generates a corresponding signal supplying an electric, electromechanical, electromagnetic or magnetic actuator, the signal generating a steering actuating travel of the motor corresponding to the one set by displacing the control member.

Solutions of this type are known in the prior art, for example under the name Steer by wire described in document EP1889751.

Still according to another feature, the remote steering station 10 may be associated to a remote unit controlling the number of revolutions of the motor and/or the setting of the reversing gear. In this case the solution can be mechanical, electromechanical or electronic such as for example described in documents EP 1598267 and/or EP2019036.

With reference to FIG. 4, said actuator should be already provided since it would replace the cylinder 121.

The diagram of FIG. 2 shows the possibility of providing a remote station with the broken block 10 that in this case is connected to a steering actuator 40.

As regards the merely mechanical solution both for the variant of FIG. 3 and for the variant of FIG. 4, the control members 3 can comprise levers, wheels or other manual grasping members that perform a predetermined travel between two extreme positions and that transmit such travel by a transmission to a mechanical locking actuator. A particular type of transmission is for example composed of one or two cables of the push-pull type.

Such cables, for example each fastened to two diametrically opposite ends of a pivoting driving level, whose pivoting movement is, for example, controlled by the end part 101 of the tiller, transmit the actuating travel directly to mechanical locking means or control, for example, the valves 421, 521 of the variant of FIG. 3.

As regards the variant of FIG. 4, also in this case the preceding description can be applied to the present embodiment.

According to another feature, in the mechanical version it is also possible to easily provide remote stations 10 preferably connected, by means of their own push-pull cables, to the actuator locking the rotation of the motor.

According to another aspect of the invention, means may be provided that generate a variable force of resistance to the rotation of the motor.

In FIG. 2 such means are denoted by 50.

Said means can be hydraulic, mechanical, electromechanical, electric, or electromagnetic.

In the hydraulic or oil-hydraulic variant of FIG. 3, for example, servo-controlled flow regulators may be provided that are placed in series with solenoid valves and that are controlled by additional control members. In FIG. 2 said control members are provided on the steering tiller 1 and are denoted by 4.

Other variants are possible, such as an electromechanical variant wherein friction means generate a higher or lower resistance to the rotation of the motor by electric control pulses generated by said control members 4.

As an alternative, in the mechanical version the friction means are controlled by a control member, for example through a transmission and possibly through one or two cables of the push-pull type controlled by the control member, which transfer a displacement generated by a travel of the control member to the friction means.

In the electromagnetic embodiment it is possible to provide an electromagnetic brake of the type used, for example, in exercise bikes or the like, such as a short-circuited electric motor and a short-circuit current regulator.

Particularly in versions that provide controls of the electric type to change the force of resistance to the rotation of the motor, said force may be regulated not only by a manual control by the user through a control member 4, but also automatically by a controller 60 that acquires signals detecting the number of revolutions of the motor and that generates, on the basis of said number of revolutions, a signal regulating the resistance to the rotation of the motor, making the rotation more or less easy depending on the number of revolutions of the motor.

Said means generating a variable force of resistance to the rotation of the motor can include a device in addition to the means locking the rotation according to FIG. 3 and/or to the means locking and actuating the rotation of the motor according to FIG. 4, or can be at the same time part of said means or of the system controlling them.

For example, in the hydraulic version, instead of the solenoid valves 421 and 521 that close or open the circuit, flow regulators may change the passage section of the fluid in a continuous and progressive manner from a complete locked condition to a condition of maximum passage for the fluid.

A similar implementation mode can be provided with the clear variants for the electromechanical or electromagnetic or mechanical solution, the resistance force may be regulated from a maximum intensity, where the rotation of the motor is practically locked, to a minimum intensity where the motor freely rotates.

The controller 60 can also be used for generating pulses activating the locking means 21, and the steering actuators 40 upon command of pulses generated by the control members 3 and 4 provided on the tiller 1 or integrated therein.

Finally, even if it is not explicitly shown or described, a system according to the present invention can be provided in combination with, or can be integrated within, a system controlling operation of the motor, wherein the control members for the operation are provided at least partially on the steering tiller 1, such as a rotatable knob to change the number of revolutions of the motor; a control of the reversing gear; a control of actuators for tilt or trim of the motor; or other possible functions.

The invention claimed is:

1. A steering control system for a watercraft comprising:

a pivoting steering tiller manually operated and operatively connected to a direction changing device acting on or into water; and a locking system that locks the steering tiller in a steering position, the locking system being configured to be activated for keeping said steering tiller in a predetermined position and to be deactivated for moving said steering tiller in a pivoting position to carry out a change in direction, wherein said locking system is switchable by switching actuators that are controlled by a control member provided on a steering arm, wherein the locking system is oil hydraulic, and comprises a hydraulic cylinder having a rod that is fastened to a transom of the watercraft in stationary position and a cylindrical body movable along said rod and connected to a steering arm of the direction changing device, or vice versa, further comprising a closed communication circuit for flowing the oil between two chambers of said hydraulic cylinder, a valve being provided within said closed communication circuit opening and closing said closed communication circuit, said actuators that switch the locking system being mechanical, electric, electromechanical, electromagnetic, electronic, hydraulic, or oil-hydraulic, the control member for said actuator being mechanical, electric, electromechanical, electromagnetic, electronic, hydraulic, or oil-hydraulic, wherein the control actuator for the locking system is a solenoid valve opening and closing the closed communication circuit between the chambers of the hydraulic cylinder, and wherein the control member provided on the steering tiller is a control pulse generator.

2. A steering control system for a watercraft comprising:

a pivoting steering tiller manually operated and operatively connected to a direction changing device acting on or into water; and a locking system that locks the steering tiller in a steering position, the locking system being configured to be activated for keeping said steering tiller in a predetermined position and to be deactivated for moving said steering tiller in a pivoting position to carry out a change in direction, wherein said locking system is switchable by switching actuators that are controlled by a control member provided on a steering arm, wherein the locking system is electric, electromechanical or electromagnetic and comprises a locking mechanism operated by electric motors or by electromagnetic force, said locking mechanism comprising at least one movable part displaceable relative to a stationary part, the movable part being connected to the arm of the direction changing device, and the stationary part being connected to a transom of the watercraft, wherein a locking device is provided between the movable part and the stationary part that is drivable electrically or magnetically and switchable from a non-interference condition, where said movable part is displaceable relative to said stationary part, to an interference position, where said movable part and said stationary part are locked one to the other with respect to a relative displacement, and wherein the control member is provided on the steering tiller and comprises a control pulse generator, a change-over switch generating a control pulse that is supplied to a power circuit for transmitting a power pulse to said electromechanical or electromagnetic actuator or that closes and opens a circuit supplying the electromagnetic or electromechanical actuator.

3. A steering control system for a watercraft comprising:

a pivoting steering tiller manually operated and operatively connected to a direction changing device acting on or into water; and a locking system that locks the steering tiller in a steering position, the locking system being configured to be activated for keeping said steering tiller in a predetermined position and to be deactivated for moving said steering tiller in a pivoting position to carry out a change in direction, wherein said locking system is switchable by switching actuators that are controlled by a control member provided on a steering arm, wherein the control member is of mechanical type and controls a pulling and pushing displacement of push-pull cables that transmit a movement to a transducer controlling said actuators switching the locking system.

4. The steering control system according to claim 1, wherein the locking system comprises a brake having a braking force adjustable to change resistance to a displacement of the direction changing device, said brake being the locking system or being provided in combination with the locking system.

5. The steering control system according to claim 4, wherein the brake is selected from the group consisting of:

a mechanical brake that generates a variable friction between the movable part and the stationary part of the locking system by mechanical transmission of a braking force set by a manual control member provided on the steering tiller, an electromechanical or electromagnetic brake comprising an electromechanical or electromagnetic device generating a force opposing a relative displacement between the movable part and the stationary part, the electromagnetic or electromechanical device being operated by the control member, the control member regulating a signal operating the electromechanical or electromagnetic device to regulate intensity of a force opposing a pivoting movement of the steering tiller, or a valve regulating a flow of a fluid within the closed communication circuit, the valve being controlled by the control member to limit flow rate of the fluid therethrough.

6. The steering control system according to claim 4, further comprising an electronic control system for the brake, the an electronic control system receiving a signal corresponding to a number of revolutions of a motor and generate a signal operating the brake to set a braking force related to the number of revolutions of the motor.

7. The steering control system according to claim 1, further comprising interfaces for connection of an associated control member to one or more remote steering stations, further comprising steering actuators that are hydraulic, oil-hydraulic, mechanical, electromechanical, or electromagnetic associated to said system.

8. The steering control system according to claim 7, wherein the locking system comprises the hydraulic cylinder, further comprising, at inlets of the cylinder chambers, terminals connecting pipes supplying pressurized oil generated by a pump of an oil-hydraulic, electric, electromechanical, electromagnetic, or mechanical steering system.

* * * * *